United States Patent [19]

Bethmann

[11] 4,102,271

[45] Jul. 25, 1978

[54] ARMOR-PIERCING TANDEM SHELL OR PROJECTILE

[75] Inventor: Karl-Wilhelm Bethmann, Duesseldorf, Fed. Rep. of Germany

[73] Assignee: Rheinmetall GmbH., Duesseldorf, Fed. Rep. of Germany

[21] Appl. No.: 767,378

[22] Filed: Feb. 10, 1977

[30] Foreign Application Priority Data

Feb. 12, 1976 [DE] Fed. Rep. of Germany ..... 26054557

[51] Int. Cl.[2] ..... F42B 11/14

[52] U.S. Cl. ..... 102/52; 102/56 SC

[58] Field of Search ..... 102/52, 56 HC, 93, 24 HC

[56] References Cited

U.S. PATENT DOCUMENTS

| | | | |
|---|---|---|---|
| 2,419,414 | 4/1947 | Mohaupt | 102/52 X |
| 3,157,124 | 11/1964 | Muller | 102/56 SC |
| 3,498,222 | 3/1970 | Birkigt | 102/52 |
| 3,613,585 | 10/1971 | Dulroff | 102/52 |
| 3,620,167 | 11/1971 | Romer et al. | 102/93 |
| 3,731,630 | 5/1973 | Muller | 102/52 |
| 3,750,582 | 8/1973 | Kintish | 102/56 SC |

FOREIGN PATENT DOCUMENTS

| | | | |
|---|---|---|---|
| 1,309,113 | 10/1962 | France | 102/52 |
| 1,209,463 | 1/1966 | Fed. Rep. of Germany | 102/56 |

*Primary Examiner*—Harold Tudor

[57] ABSTRACT

An armor-piercing tandem projectile adapted for multi-layered armored targets. Two armor-penetrating devices are incorporated in the body of the tandem shell projectile which differentiate each other with respect to their moments of impact; the rear armor-penetrating device incorporates a shaped hollow explosive charge including a cavity lining forming an armor-penetrating spike (projectile with high initial velocity) upon detonation. The forward armor-penetrating device has a pointed end with an axial conduit which is in communication with the hollow explosive charge and serves as a passageway for said spike.

8 Claims, 2 Drawing Figures

ARMOR-PIERCING TANDEM SHELL OR PROJECTILE

This invention relates to an armor-penetrating tandem-projectile adapted in particular for compartmentalized targets (multi-layer armor). Two armor-penetrating devices are incorporated in the shell body of a tandem shell. These armorpenetrating devices distinguish each other with respect to their moment of impact; the rear one of the two devices encompasses a shaped hollow explosive charge arrangement.

The afore-described type of armor-piercing tandem projectile is already known and has been described in the "Jahrbuch der Wehrtechnik," Folge 8, 1974 (Wehr und Wissen, Verlagsgesellschaft mbH., Koblenz-Bonn-Darmstadt), page 163, FIG. 16. Such a device has two coaxial shaped hollow explosive charges arranged one behind the other. When the device impacts on a target the rear shaped hollow explosive charge is the one that first becomes operative. From a lining forming part of the rear charge a pointed spike is formed; this spike is adapted to be ejected through the forward hollow charge by passing through an opening disposed in the apex of the forward charge and produces a channel in the armor plate of the target. The forward shaped hollow explosive charge is thus ignited with delay relative to ignition of the rear shaped hollow explosive charge. The pointed spike formed by the forward shaped hollow explosive charge thus follows the said channel produced by the rear shaped hollow explosive charge and becomes operative at a preselected position.

It has been observed that difficulties occur when the compartmentalized reinforced target is impacted obliquely by the afore-described known projectile. The difficulties can be attributed to the strongly reduced cross section of the penetrating channel produced by the spike of the first shaped hollow explosive charge as compared to the cross section of such a channel when a perpendicular impacting of the shell and the target occurs. Consequently, only a relatively small surface area is damaged which is a drawback. A further drawback resides in the behavior of such a known shell relative to an active armor. What is meant here by an active armor is an arrangement of explosive charges in the region of the outer armor, by the activation of which the spike formed by the shaped hollow explosive charge is disturbed and is made ineffective with respect to the main armor.

SUMMARY OF THE INVENTION

It is an object of the invention to avoid the drawbacks of the afore-described known armor-piercing tandem projectile.

This object is attained by providing an armor-piercing tandem projectile adapted for compartmentalized targets (multi-layer armor) in which the two armor-piercing devices are unified in one shell body. The activation of the two armor-piercing devices is not simultaneous and the rear device surrounds a shaped hollow explosive charge, while the forward device is effective by virtue of its kinetic energy.

The invention provides the technical advantage, that, even when the shell of the invention impacts the target obliquely, the outer armor is penetrated over a relatively large cross-sectional area. Moreover, the detonation distance (stand-off distance) between the shaped hollow explosive charge and the main armor is optimized. Furthermore, any encroachments to the shaped hollow explosive charge spike, due to malfunctioning of the charge at an active armor, is avoided.

BRIEF DESCRIPTION OF THE DRAWING

The invention is further set forth in the following detailed description of a preferred embodiment thereof, taken in conjunction with the appended drawing, in which.

DETAILED DESCRIPTION

Figure 1:
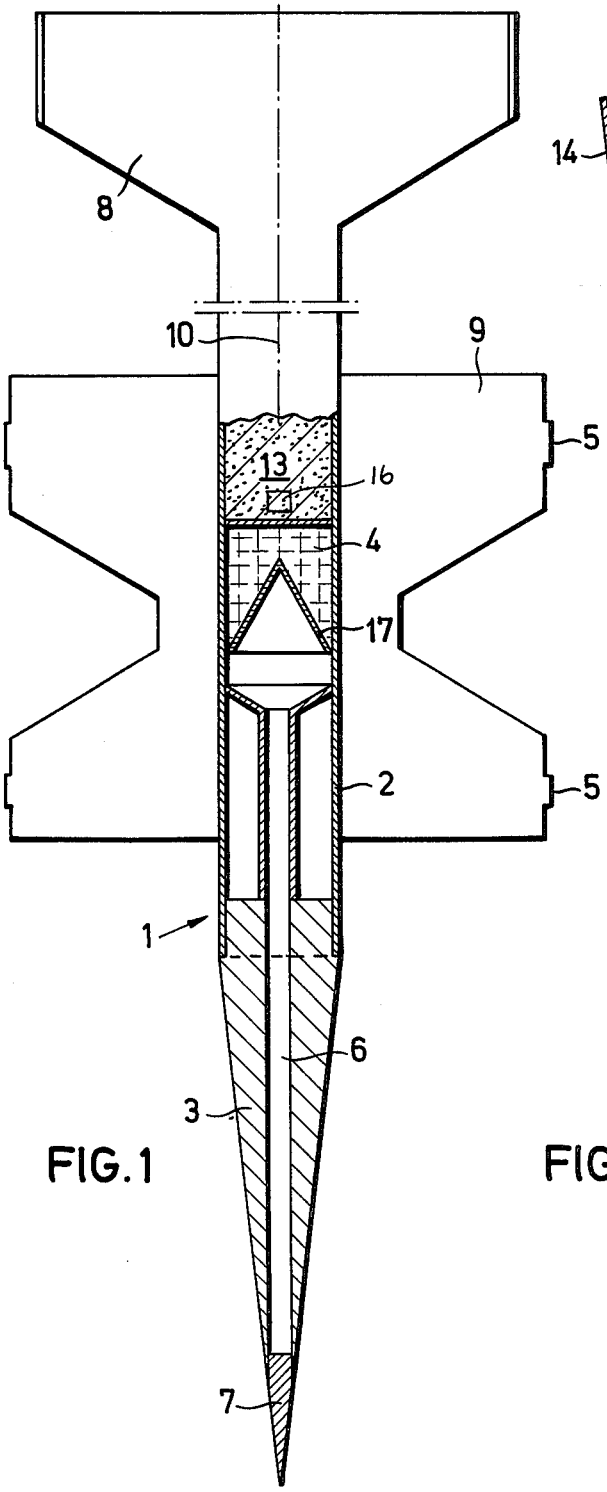
FIG. 1 illustrates a projectile, in accordance with the invention, being of the sub-calibre type, including a sabot and an arrow-stabilizing guide wing arrangement, partially in section, in which those parts of the invention which are conventional have been omitted or are only illustrated in light-dashed lines for sake of clarity.
Figure 2:
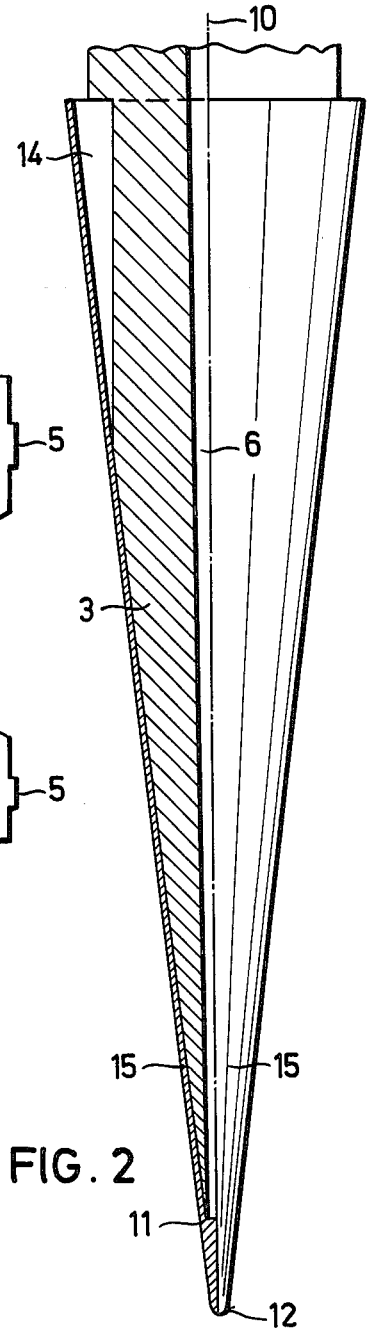
FIG. 2 is a partially sectional side view of the impact body of the projectile or shell of the invention.

Referring now to the drawing there is illustrated a projectile body 1 having a cylindrical portion 2 and, in the forward region of the projectile, an impact body 3. A shaped hollow explosive charge 4 provided with a spike-forming liner 17 is disposed within the cylindrical portion 2. This shaped hollow explosive charge 4 is coaxially arranged relative to the longitudinal axis 10 of the projectile. A conduit or channel 6 in the forward impact body 3 is in communication with the shaped hollow explosive charge 4. The channel 6 has an outlet 11 adjacent to the forward point 12 of the projectile. The forward point 12 forms part of the impact body 3. The cylindrical portion 2 of the projectile body 1 has optionally mounted thereon a sabot 9 in its central region and in its stern position there is optionally mounted a wingstabilizing guide member 8. The sabot 9 is advantageously exchangeably mounted. In this manner a sub-calibre projectile can be ejected out of barrels of different calibre. In the event the flight path of the projectile is to be spin-stabilized, then guide rings 5 are advantageously provided at the lateral extremeties of the sabot 9 as illustrated in FIG. 1. If the projectile is so equipped, the wing-stabilizing guide member 8 can be dispensed with, but the impact body 3 can be advantageously provided with projections 14; on penetrating the outer armor the projections 14 coact frictionally with the edge of the resulting hole in the outer armor, thereby eliminating the spin of the projectile prior to the ignition of the shaped hollow explosive charge 4. The projectile can be provided with a ballistic hood 15 as illustrated in FIG. 2, in particular when these features are required, e.g. by said projections 14, for an optimum streamlined profile.

The tandem projectile in accordance with this invention combines two basic different effects, which are as follows: 1) That of the pure impact projectile and 2) that of the shaped hollow explosive charge. In order to attain the largest possible kinetic energy and thereby impact effect, it is recommended that the projectile be embodied as a sub-calibre projectile with a corresponding sabot arrangement. On the other hand, independently from the embodiment of the shaped hollow explosive charge with a pointed cone or flat cone shape, the wing-stabilizing member is not required. This will follow from the described effect of the projectile, as set forth hereinbelow.

Upon impact of a compartmentalized armored target there is first of all absorbed the inherent kinetic energy of the projectile via the impact body 3 by the outer armor of the target. The outer armor is thereby penetrated by the impact body 3 over an area corresponding to the impact surface of the impact body 3. Simultaneously therewith the shaped hollow explosive charge 4 is positioned with an advantageous detonation distance from the main armor of the target. A fuze 16 can be adjusted in such a way that it is activated only if the velocity of a projectile falls under a predetermined value (that is in the firing direction as well as in a translation about the longitudinal axis of the projectile; the latter applying to a flight path along which the projectile is spin-stabilized). When a spin-stabilized flight path is utilized with a projectile provided with a cone-shaped hollow explosive charge, a rotation about the longitudinal axis of the projectile is to be eliminated as early and as effectively as possible after striking the armored target. This can be accomplished by providing to the outer periphery of the impact body 3 the spin-retarding projections 14 which frictionally, mutually coact with the outer armor.

After the outer armor has been penetrated, the impact body 3 with its guide channel 6 provides a reliable protection for the shaped hollow explosive charge spike, particularly against encroachments by means of active armor charges. The outlet 11 advantageously directly "aims" on the main armor. Therefore, the shaped hollow explosive charge 4 can become effective without any impediments.

A deep penetration of the projectile in the armored target is favored by shaping the impact body 3, in particular in the region of the outlet 11 of the guide channel 6, as an annular chisel. The impact body 3 can furthermore be formed at its forward point 12 with a very hard material 7, e.g. a metal carbide. By means of an additional useful charge 13 and due to the penetration of the projectile over a relatively large surface in the region of the outer armor, incendiary (e.g. powdered zirconium metal), smoke generating (e.g. titanium tetrachloride), or marking (e.g. beta-naphtol orange) materials can extensively become effective, while at the same time being shielded from all types of wind effects.

It is to be understood that the arrangement of the invention can not only be used in projectiles which are propelled from tubular barrels. They can advantageously also be applied to all types of bodies in flight which impact a target with sufficient velocity and concomitant impact effect. Furtermore, its application is not limited to a bottom-bottom application.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. An improved armor-piercing tandem projectile particularly adapted for piercing multi-layered armored targets and having a shell body incorporating at least two armor-piercing means which differentiate each other at least with respect to their moments of impacting the target, the rearmost one of the armor-piercing means including a shaped hollow explosive charge; the improvement comprising:

a first most forwardly disposed armor-piercing means, relative to the target, having the first, in point of time, impacting moment of said armor-piercing means, acting by its kinetic energy;

a second most rearwardly disposed armor-piercing means having a chamber;

said first and second armor-piercing means being rigidly secured to each other, shaped hollow explosive charge means operatively mounted in said chamber, said shaped hollow explosive charge means including spike forming means;

said first armor-piercing means being formed as an impact body which has a fowardly extending conduit in communication with said shaped hollow explosive charge means.

2. The improvement in an armor-piercing tandem projectile as set forth in claim 1, wherein said impact body has a pointed forward end, said conduit having an outlet in the pointed forward end of said impact body.

3. The improvement in an armor-piercing tandem shell or projectile as set forth in claim 2, wherein said impact body has a pointed forward end, at least a portion of said pointed forward end being formed of metal carbide.

4. The improvement in an armor-piercing tandem projectile as set forth in claim 3, wherein said armor-piercing shell or projectile is of a subcalibre type and includes exchangeable sabot means operatively mounted on said subcalibre projectile.

5. The improvement in an armor-piercing tandem projectile as set forth in claim 4, wherein said subcalibre projectile further includes wing stabilizing means operatively mounted on said shell body.

6. The improvement in an armor-piercing tandem projectile as set forth in claim 3, wherein said impact body includes streamlined projections extending therefrom.

7. The improvement in an armor-piercing tandem projectile as set forth in claim 6, including an additional payload operatively mounted in said shell body behind said hollow explosive charge means.

8. The improvement in an armor-piercing tandem projectile as set forth in claim 7, wherein said payload includes materials selected from the group of incendiary, marking and smoke generating substances.

* * * * *